US005820394A

United States Patent [19]

Kameyama et al.

[11] Patent Number: 5,820,394

[45] Date of Patent: Oct. 13, 1998

[54] MOVABLE CONNECTOR POSITIONING MECHANISM

[75] Inventors: Isao Kameyama; Hideto Kumakura, both of Shizuoka, Japan

[73] Assignee: Yazaki Corporation, Tokyo, Japan

[21] Appl. No.: 722,551

[22] Filed: Sep. 27, 1996

[30] Foreign Application Priority Data

Sep. 28, 1995 [JP] Japan ..... 7-251064

[51] Int. Cl.[6] ..... H01R 13/64

[52] U.S. Cl. ..... 439/248; 439/557; 439/567

[58] Field of Search ..... 439/557, 567, 439/571–573, 554, 374, 248

[56] References Cited

U.S. PATENT DOCUMENTS

| | | | |
|---|---|---|---|
| 4,173,387 | 11/1979 | Zell | 439/557 |
| 5,002,494 | 3/1991 | Olsson | 439/77 |
| 5,249,982 | 10/1993 | Funck et al. | 439/557 |
| 5,338,226 | 8/1994 | Bryce et al. | 439/571 |

FOREIGN PATENT DOCUMENTS

| | | | |
|---|---|---|---|
| 0 631 351 | 12/1994 | European Pat. Off. | H01R 23/66 |

*Primary Examiner*—Neil Abrams
*Assistant Examiner*—Brian J. Biggi
*Attorney, Agent, or Firm*—Sughrue, Mion, Zinn, Macpeak & Seas, PLLC

[57] ABSTRACT

A movable connector positioning mechanism and method for preventing unnecessary movement of a movable connector before fitting to a mating connector so that the movable connector can be located and held in a proper position to eliminate misregistration between the movable and mating connectors. The movable connector is mounted to a mounting member having a mounting hole. The mechanism includes a support plate which is integral with a connector housing of the movable connector and includes a retaining portion which projects from one side of the support plate and is adaptable for insertion into a mounting hole. The mechanism further includes a positioning member having a first component on the mounting member and a second component on the support plate, which engage to prevent rotation of the retaining portion about an axis of insertion of the retaining portion so as to locate the connector housing in a predetermined position when the retaining portion is being inserted into the mounting hole. The first component is a hole and the second component is a projection or vice versa. The engagement of the first and second components is released as the movable connector is being mated with the mating connector.

8 Claims, 8 Drawing Sheets

MOVABLE CONNECTOR POSITIONING MECHANISM

BACKGROUND OF THE INVENTION

1. Field of the Invention

The present invention relates to a movable connector positioning mechanism which prevents unnecessary movement of a movable connector, to thus properly locate the connector in a predetermined position before it is fitted to a mating connector so that the connector can easily mate with the mating connector.

2. Related Art

A vehicle, for example, typically includes various types of parts which are mounted on its surface and supplied with electric power. For instance, FIG. 10 illustrates a lamp 9 which is mounted to an inside roof of a vehicle.

In order to mount the lamp 9 to the roof, a mounting configuration is used in which a vehicle body connector 3, having a wire 1 connected thereto, is mounted on a roof bow 5, and a lamp connector 7, which engages with the vehicle body connector 3, is mounted on the lamp 9. Thus, the electrical coupling of the connectors is completed simultaneously with the mounting of the lamp 9.

In such a mounting configuration, in order to absorb relative misregistration between the two connectors 3 and 7, the vehicle body connector 3 must be fitted relative to the lamp connector 7 while moving the vehicle body connector 3 relative to the position of the lamp connector 7 when the lamp 9 is to be mounted. It is therefore advantageous to use a connector which is movable so as to absorb misregistration that develops when mounting the lamp.

FIG. 11 is an exploded, perspective view of such a conventional movable connector. In this movable connector 11, an elastic retaining piece portion 13 is formed on each side face of a connector housing of a rectangular parallelepiped shape, and retaining projections 13*a* of these elastic retaining piece portions 13 are retainingly engaged with a peripheral edge portion of a mounting hole 15, thus securing the movable connector 11 on the roof bow 5.

In this movable connector 11, the connector housing is retained relative to the mounting hole 15 through the elastic retaining piece portions 13. The movable connector 11 can move slightly due to elastic deformation of the elastic retaining piece portions 13, and thereby absorb misregistration between the connector 11 and a mating connector (not shown).

In the above conventional movable connector 11, however, the elastic retaining piece portions 13, formed respectively on the four side faces of the connector housing, are resiliently urged against the four sides of the peripheral edge of the rectangular mounting hole 15, so that the retaining projections 13*a* retainingly engage with the peripheral edge portion of the mounting hole 15. Therefore, if a force acts on the movable connector 11 to turn it about an axis c of insertion before the two connectors are fitted together as shown in FIG. 12, the elastic retaining piece portions 13 are flexed inwardly so that the movable connector can easily turn or rotate in the retained condition. If such rotation is excessive, the misregistration is not absorbed properly, and it is thus difficult to mate the connector 11 with the mating connector.

Another type of movable connector 23 is shown in FIG. 13, in which an insertion axis c of a retaining portion 19 and a fitting axis e of the connector portion 21 do not coincide with each other. Hence, if the retaining portion 19 turns about the insertion axis c, the connector portion 21 moves on a circle having its center on the retaining portion 19, and is thus greatly displaced out of position. Therefore, the connector portion 21 must be manually returned to the proper position, which requires additional time and labor. Furthermore, the lamp 9 can be mounted in such a manner so that the connector 21 is not properly fitted.

SUMMARY OF THE INVENTION

Accordingly, an object of the present invention is to provide a movable connector positioning mechanism which prevents unnecessary movement of a movable connector before it is fitted relative to a mating connector, so that the connector portion can be located and held in a proper position, thus eliminating misregistration between the movable and mating connectors. To achieve this object, a mounting hole of a rectangular shape is formed in the mounting member to which the movable connector is mounted, and a support plate is formed integrally with a connector housing of the movable connector and is parallel to a plane perpendicular to a fitting axis of the connector. Furthermore, a retaining portion projects from one side of the support plate and is inserted into the mounting hole and thus retained by the mounting hole.

The mechanism also includes a positioning apparatus which comprises a hole present in the mounting member and a convex projection on the support plate. Hence, when the retaining portion is retained in the mounting hole and the movable connector is mounted in the proper position, the convex portion is fitted into the hole in the mounting member to prevent the movable connector from being easily moved. Accordingly, the movable connector is located and held in the proper position. When a mating connector is attached to the movable connector in this condition, the two connectors begin to engage each other, and the movable connector begins to move, so that the convex portion is disengaged from the hole. As a result, the movement limitation on the movable connector is released, so that the movable connector can move so as to absorb misregistration between itself and the mounting connector.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
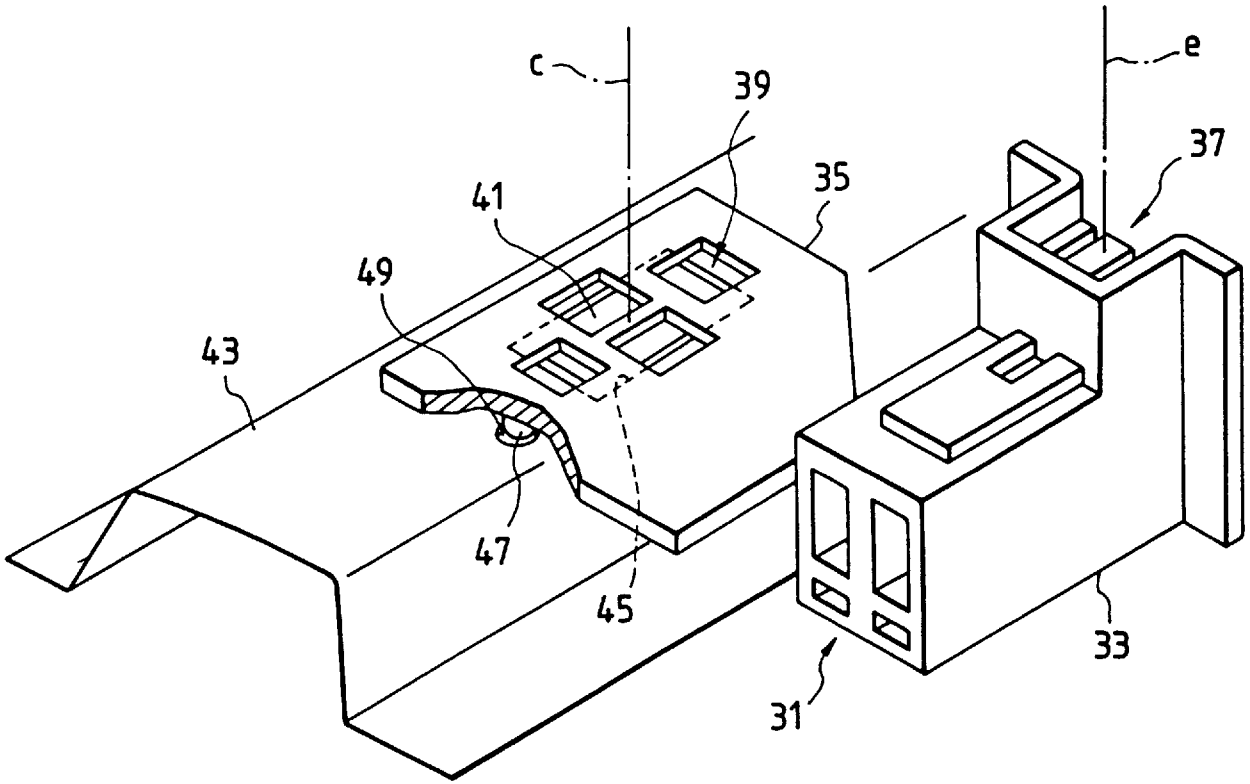
FIG. 1 is a perspective view of a movable connector positioning mechanism of an embodiment of the present invention.
Figure 2:
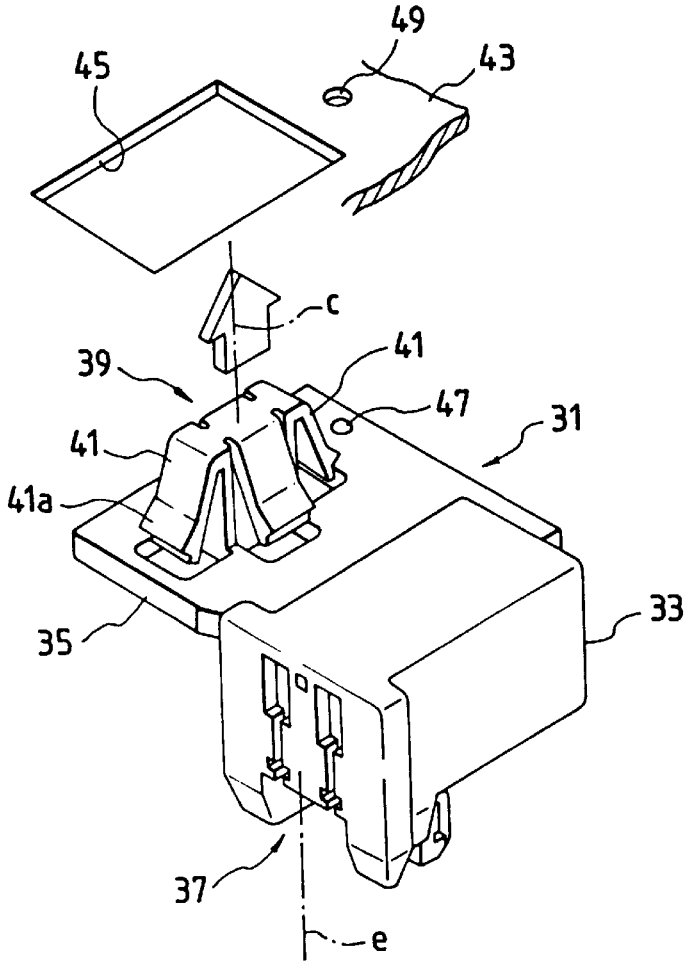
FIG. 2 is an exploded, perspective view of the movable connector positioning mechanism shown in FIG. 1.
Figure 3A:
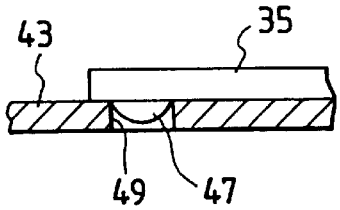
FIGS. 3A and 3B are enlarged views of a portion of the positioning mechanism of FIG. 1.
Figure 3B:
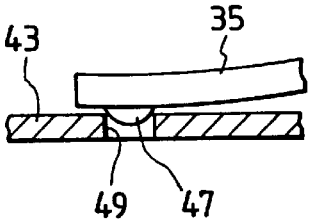

FIG. 1 is a perspective view of an embodiment of the movable connector positioning mechanism of the invention, FIG. 2 is an exploded, perspective view of the positioning mechanism shown in FIG. 1, and FIGS. 3A–3B are an enlarged view of an important portion of the positioning mechanism shown in FIG. 1. As shown in FIGS. 1 and 2, a support plate 35 is formed integrally with a connector housing 33 of a movable connector 31, and is parallel or substantially parallel to a plane perpendicular to an axis e for fitting of the connector. A retaining portion 39 is formed on and projects from the side or face of the support plate 35 in a direction facing away from a connector fitting surface 37.

Elastic retaining piece portions (clips) 41 are provided respectively at four sides of the retaining portion 39, and each of the clips 41 are retained by its retaining projection 41*a* which abuts against a corresponding side of a peripheral edge of a rectangular mounting hole 45 formed through a mounting member (e.g., roof bow) 43. The clips 41 are connected together at their upper or proximal ends, and their downwardly-directed free or distal end portions are movable. The clips 41 are inserted into the mounting hole 45, with their proximal ends first introduced into this mounting hole 45, when the retaining portion 39 is inserted in the mounting hole 45.

A position limitation apparatus (e.g., a convex portion) 47 having a semi-spherical shape is formed on and projects from that side or face of the support plate 35 from which the clips 41 project. A position limitation component (e.g., a hole) 49 is formed through the mounting member 43, and is disposed adjacent to the mounting hole 45. The position limitation apparatus and hole can be of any practical corresponding shape which enable the position limitation apparatus to mount in the hole.

When the clips 41 are retained in the mounting hole 45, and the movable connector 31 is located in a proper position as shown in FIG. 1, the convex portion 47 is fitted in the hole 49 in the mounting member 43 as shown in FIG. 3A. The convex portion 47 is equal or substantially equal in diameter to the hole 49 as shown in FIG. 3A, or is slightly larger than the hole 49 as shown in FIG. 3B.

Figure 4A:
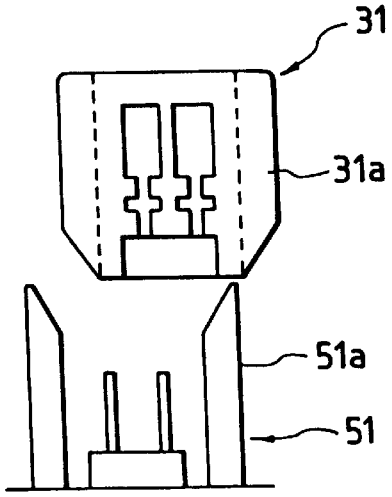
FIGS. 4A–4C are views showing the manner in which misregistration between the movable connector and mating connector is absorbed.
Figure 4B:
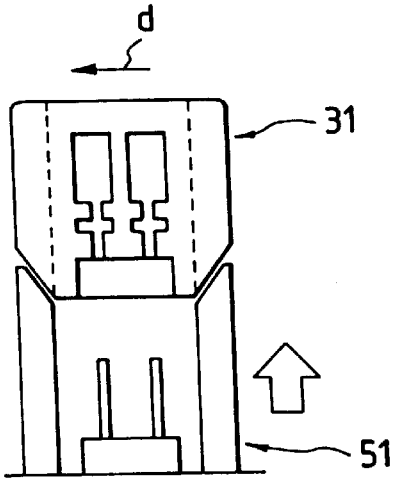
Figure 4C:
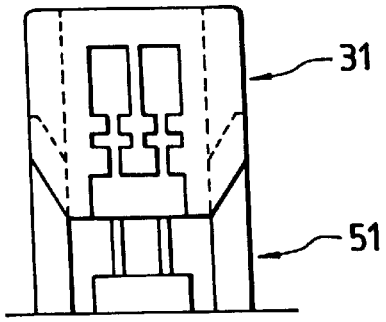
Figure 5A:
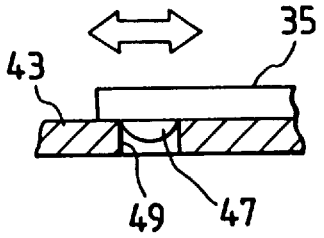
FIGS. 5A–5C are views showing the relation between a convex portion on the support plate of the connector and a hole in which the convex portion is inserted when absorbing the misregistration between the movable and mating connectors.
Figure 5B:
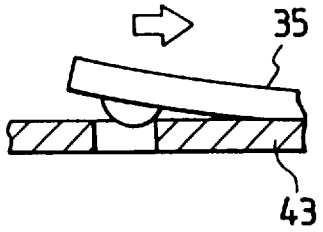
Figure 5C:
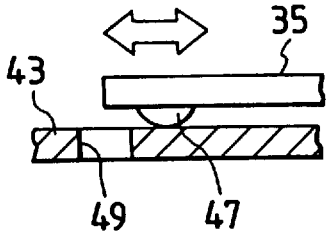

The operation of the movable connector-positioning mechanism of this configuration will now be described. FIGS. 4A–4C are views showing the manner of absorbing misregistration between the movable connector and the mating connector, and FIGS. 5A–5C are views showing the relation between the convex portion and the hole when absorbing the misregistration. When the clips 41 are inserted into the mounting hole 45 in the mounting member 43, the retaining projections 41*a* of the clips 41 are retainingly engaged with the peripheral edge portion of the mounting hole 45, so that the movable connector 31 is mounted on the mounting member 43 as shown in FIG. 1.

When the movable connector 31 is mounted in position on the mounting member 43, the convex portion 47, projecting from the support plate 35, is fitted in the hole 49 formed through the mounting member 43. As a result, even if an external force acts on the movable connector 31, the engagement of the convex portion 47 and hole 49 prevents the movable connector 31 from being easily moved. The movable connector 31 is located and held in the proper position on the mounting member 43 until a mating connector 51 which is, for example, mounted on a lamp unit (not shown), is attached to the movable connector.

When the mating connector 51, mounted on the lamp unit, is attached to the movable connector 31 held in the above condition (see FIGS. 4A to 4C), a guide 51*a* of the mating connector 51 and a guide 31*a* of the movable connector 31 guide each other, so that relative misregistration between the two connectors is absorbed by a guide force indicated by arrow d in FIG. 4B. When the misregistration thus begins to be absorbed, the movable connector 31 begins to move.

When the movable connector 31 thus begins to move (see FIGS. 5A to 5C), this moving force overcomes the fitting force holding the convex portion 47 in the hole 49, and the support plate is elastically deformed, so that the convex portion 47 is disengaged from the hole 49. As a result, the movement limitation, accomplished by the engagement of the convex portion 47 in the hole 49, is released as shown in FIG. 5C, so that the movable connector can move so as to absorb the misregistration with the mating connector 51.

In the movable connector-positioning mechanism of this configuration, by fitting the convex portion 47, formed on the support plate 35, in the hole 49 in the mounting member 43, unnecessary movement of the movable connector 31 before the fitting of the connector is prevented. Therefore, the movable connector 31 can be located and held in the proper position to minimize misregistration between the movable and mating connectors.

As a result, a fitting failure of the connector due to the misregistration between the movable connector 31 and a mating connector at the time of mounting the device is prevented, and the fitting reliability of the movable connector 31 can be enhanced. Again, when fitting the connector, the convex portion 47 is disengaged from the hole 49 because of the guide force acting between the movable connector and the mating connector 51, so that the movement limitation on the movable connector 31 is released, thereby absorbing any misregistration between the mating and movable connectors.

In the above embodiment, although the convex portion 47 is provided on the support plate 35 of the movable connector 31 while the hole 49 is formed in the mounting member 43, the hole 49 instead can be formed in the support plate 35 and the convex portion 47 can be formed on the mounting member 43, in which case similar effects can be achieved.

Figure 6:
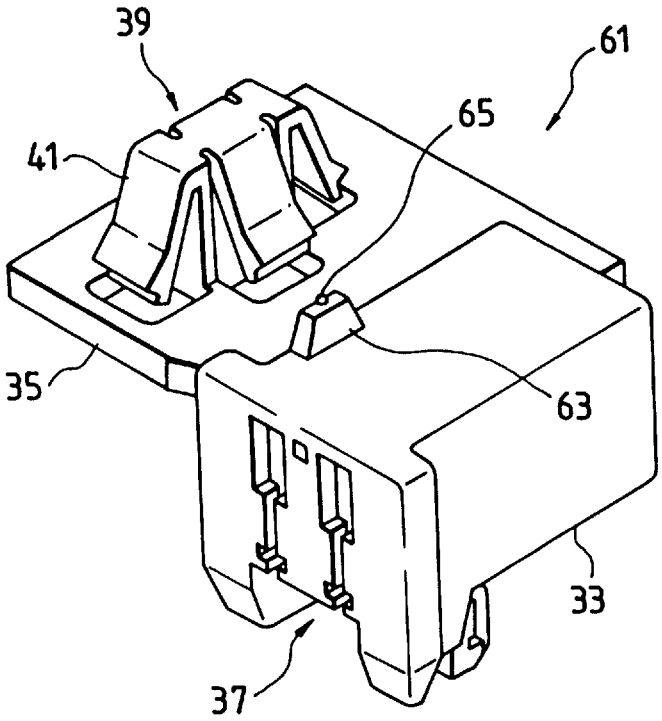
FIG. 6 is a perspective view of a movable connector of another embodiment of the present invention.

Another embodiment of a positioning mechanism of the invention will now be described with reference to FIGS. 6 through 9A–9C. FIG. 6 is a perspective view of a movable connector of this embodiment. The positioning mechanism of this embodiment is identical to the above positioning mechanism in that a support plate 35 is formed integrally with a connector housing 33 of the movable connector 61, a retaining portion 39 is formed on and projects from the support plate 35, and the retaining portion 39 is retained by clips 41 in a mounting hole 45 which is formed in a mounting member 43 (see FIG. 2).

A suppressing projection 63 for limiting excessive displacement of the connector housing 33 is formed on a rear surface of the connector housing 33 facing away from a connector fitting surface 37, and projects in the same direction as the direction of projection of the clips 41. A position limitation apparatus (e.g., a small projection) 65 of a semi-spherical shape is formed on a distal end of the suppressing projection 63.

Figure 7:
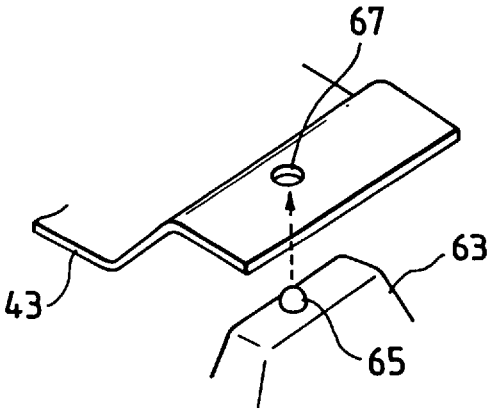
FIG. 7 is an enlarged view of a portion of a positioning mechanism of the embodiment shown in FIG. 6.
Figure 8A:
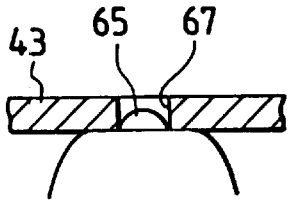
FIGS. 8A and 8B are views showing the relation between a convex portion of the movable connector shown in FIG. 6 and a hole in which the convex portion is mounted as shown in FIG. 7.
Figure 8B:
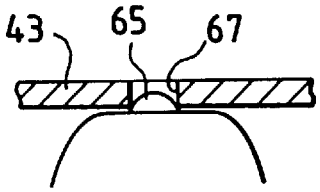

As shown in FIG. 7, a position limitation component (e.g., hole) 67 is formed through that portion of the mounting member 43 facing the rear surface of the connector housing 33. When the clips 41 are retained in the mounting hole 45, and the movable connector 61 is located in the proper position, the small projection 65 is fitted in the hole 67 in the mounting member 43. The small projection 65 is equal or substantially equal in diameter to the hole 67 as shown in FIG. 8A, or is slightly larger than the hole 67 as shown in FIG. 8B.

In the movable connector positioning mechanism of this embodiment, when the movable connector 61 is mounted in position on the mounting member 43, the small projection 65 is fitted in the hole 67 formed in the mounting member 43. Hence, even if an external force acts on the movable connector 61, the movable connector 61 is prevented from movement, and is located and held in the proper position until the mating connector (e.g., mounted on the room lamp unit) is attached to the movable connector 61.

Figure 9A:
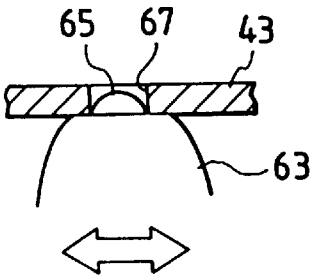
FIGS. 9A–9C are views showing the relationship between the positions of the convex portion and the hole when absorbing misregistration between the connector shown in FIG. 6 and a mating connector.
Figure 9B:
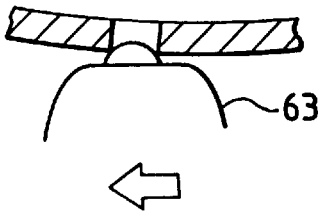
Figure 9C:
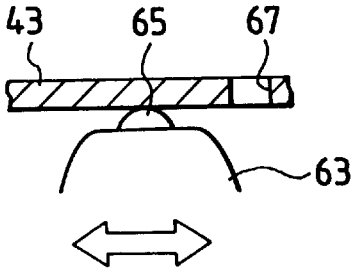
Figure 10:
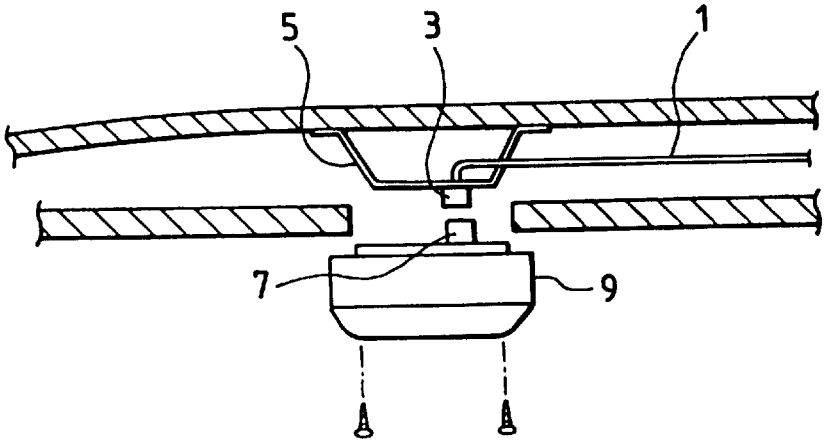
FIG. 10 PRIOR ART
FIG. 10 is a cross-sectional view showing a conventional room lamp mounting construction.
Figure 11:
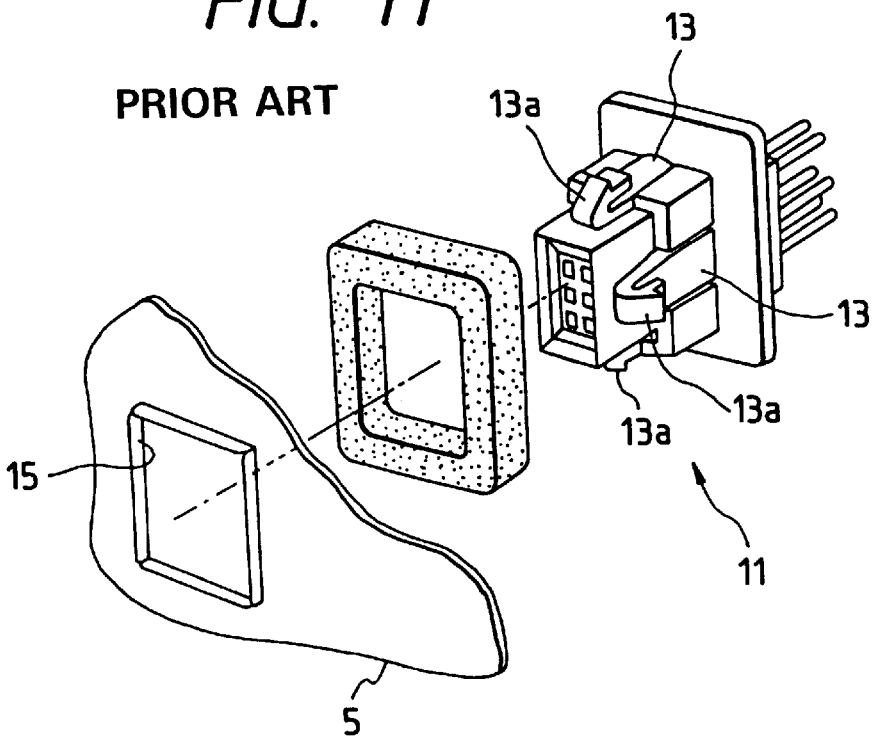
FIG. 11 PRIOR ART
FIG. 11 is a perspective view showing a conventional movable connector.
Figure 12:
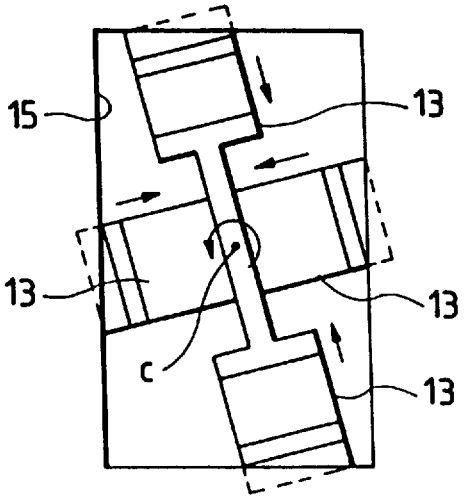
FIG. 12 PRIOR ART
FIG. 12 is a view showing a manner of rotation of the conventional movable connector.
Figure 13:
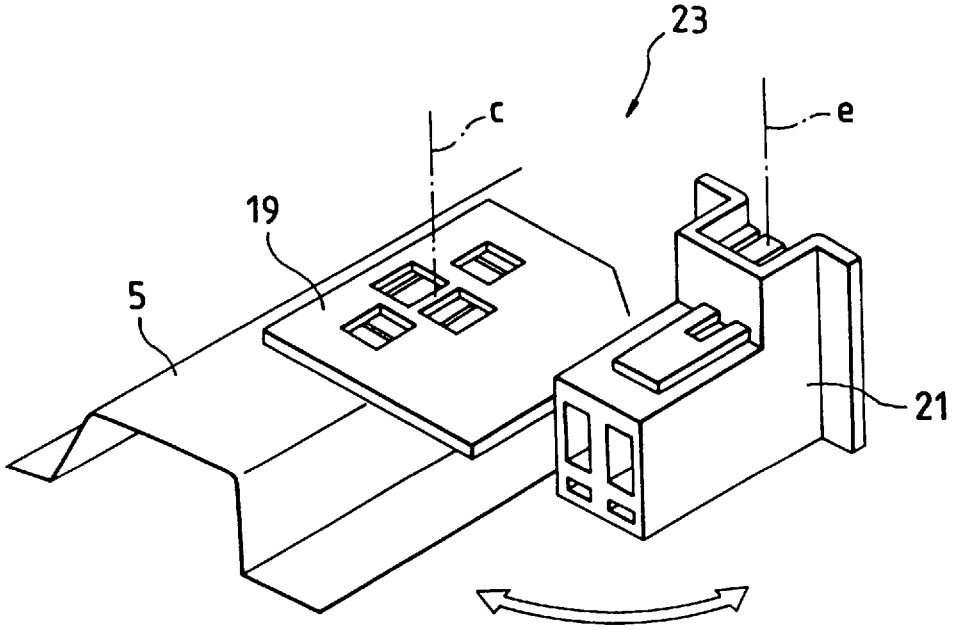
FIG. 13 is a view showing a manner of rotation of a movable connector of the type in which an insertion axis of a retaining portion is different from a fitting axis of the connector.

When the mating connector 51 (see FIGS. 4A–4C) is attached to the movable connector 61, the mating connector 51 and the movable connector 61 guide each other, so that the movable connector 61 begins to move so as to absorb relative misregistration between the two connectors. When the movable connector 61 thus begins to move, this moving force overcomes the fitting force of the small projection 65, so that the small projection 65 is disengaged from the hole 67 as shown in FIGS. 9A through 9C. As a result, the engagement between the small projection 65 and the hole 67 is released, so that the movable connector can move so as to absorb the misregistration between the movable connector and the mating connector 51.

In the movable connector-positioning mechanism of this embodiment, by fitting the small projection 65, formed on the connector housing 33, in the hole 67 in the mounting member 43, unnecessary movement of the movable connector 61 before the fitting of the movable connector with the mating connector is prevented. Therefore, as in the positioning mechanism of the first embodiment, the movable connector 61 can be located and held in the proper position to prevent fitting failure of the connector due to the misregistration between the movable connector 61 and mounting connector at the time of mounting the device. Thus, the fitting reliability of the movable connector 61 is greatly enhanced.

When fitting the connector, the small projection 65 is disengaged from the hole 67 because of the guide force acting between the movable connector and the mating connector 51 as in the first embodiment, so that the movement limitation on the movable connector 61 is released. Thus, misregistration between the connectors is absorbed. Furthermore, as in the first embodiment, although the small projection 65 and suppressing projection 63 are provided on the movable connector 39 while the hole 67 is formed in the mounting member 43, the hole 67 instead can be formed in the movable connector and small projection 65 and suppressing projection 63 can be formed on the mounting member 43, in which case similar effects can be achieved.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A movable connector positioning mechanism for positioning a movable connector relative to a mounting member having a mounting hole therein before the movable connector is fitted relative to a mating connector, comprising:

a support plate coupled to a connector housing of the movable connector, said support plate comprising a retaining portion which projects from one side thereof and is adaptable for insertion into said mounting hole; and a positioning member having a first component on said mounting member and a second component on said support plate, which prevents rotation of said retaining portion about an axis of insertion of said retaining portion so as to locate said connector housing in a predetermined position when said retaining portion is being inserted into said mounting hole, said positioning member being releasably fitted to provide movement to said connector housing for engaging with the mating connector.

2. A movable connector positioning mechanism as claimed in claim 1, wherein said first component of said positioning member is a positioning hole formed in said mounting member, and said second component of said positioning member is a projection which is formed on said support plate and projects in a direction of projection of said retaining portion, such that when said retaining portion is retained in said mounting hole, said projection is releasably fitted in said positioning hole.

3. A movable connector positioning mechanism as claimed in claim 2, wherein a diameter of said positioning hole is equal to or smaller than a diameter of said projection.

4. A movable connector positioning mechanism as claimed in claim 2, wherein said projection is a convex portion of a semi-spherical shape.

5. A movable connector positioning mechanism as claimed in claim 1, wherein said second component of said positioning member is a positioning hole formed in said support plate, and said first component of said positioning member is a projection formed on said mounting member such that when said retaining portion is retained in said mounting hole, said projection is releasably fitted in said positioning hole.

6. A movable connector positioning mechanism as claimed in claim 1, wherein said support member is integral with said connector housing.

7. A movable connector positioning mechanism as claimed in claim 1, wherein said support member extends in a direction parallel to a plane perpendicular to a fitting axis along which said movable connector is fitted with the mating connector.

8. A method for positioning a movable connector relative to a mounting member having a mounting hole therein before the movable connector is fitted relative to a mating connector, said movable connector comprising a support plate coupled to a connector housing thereof, said support plate comprising a retaining portion which projects from one side thereof and is adaptable for insertion into said mounting hole, and wherein a positioning member has a first component on said mounting member and a second component on said support plate, said method comprising the steps of:

inserting said retaining portion into said mounting hole;

engaging said first and second components of said positioning member when said retaining portion is being inserted into said mounting hole to prevent rotation of said retaining portion about an axis of insertion of said retaining portion so as to locate said connector housing in a predetermined position;

fitting said movable and mating connectors together; and releasing engagement of said first and second components as said movable and mating connectors are being fitted together.

* * * * *